US006193874B1

(12) United States Patent
Chern

(10) Patent No.: US 6,193,874 B1
(45) Date of Patent: Feb. 27, 2001

(54) HIGH COMBUSTION EFFICIENCY FUEL GAS

(76) Inventor: Hong-Line Chern, No. 21, Lane 457, Lung-chiang Rd., Taipei (TW)

( * ) Notice: Subject to any disclaimer, the term of this patent is extended or adjusted under 35 U.S.C. 154(b) by 0 days.

(21) Appl. No.: 09/407,095

(22) Filed: Sep. 28, 1999

(51) Int. Cl.[7] ..... C10L 3/12

(52) U.S. Cl. ..... 208/15; 585/6; 585/14; 48/197 FM; 48/199 FM

(58) Field of Search ..... 585/6, 14; 208/15; 48/197 FM, 199 FM

(56) References Cited

U.S. PATENT DOCUMENTS 3,925,033 * 12/1975 Mayo ..... 48/197 FM
4,640,675 * 2/1987 Green et al. ..... 48/197 FM
4,643,666 * 2/1987 Green et al. ..... 48/197 FM

FOREIGN PATENT DOCUMENTS

1243148A * 2/2000 (CA) .

* cited by examiner

*Primary Examiner*—Jacqueline V. Howard
(74) *Attorney, Agent, or Firm*—Rosenberg, Klein & Lee

(57) ABSTRACT

A high combustion efficiency fuel gas obtained from a saturated gas produced by pumping petroleum gas to a light oil composed of butane, pentane, hexane, and octane.

3 Claims, 1 Drawing Sheet

HIGH COMBUSTION EFFICIENCY FUEL GAS

BACKGROUND OF THE INVENTION

The present invention relates to fuel gas, and more particularly a high combustion efficiency fuel gas, which, when mixed with oxygen, can be quickly burned to produce high temperature flame for use in welding.

In welding, inflammable gas is mixed with oxygen in a mixing chamber in the torch, and then the fuel fixture is burned with a high temperature flame at the tip of the torch for melting metal. Acetylene is most commonly used inflammable gas in welding. However, acetylene may explore if it is not properly handled. Further, during the production of acetylene, much calcium carbide and electric energy are consumed. In recent years, LPG (liquefied petroleum gas) has been intensively used in welding instead of acetylene due to the advantage of low cost, fine cutting surface, easy removal of oxidized iron chips, etc. However, LPG is still not safe in use because it cannot be maintained in the liquefied state under the atmospheric pressure. LPG may explore if it is not properly handled. Because LPG is a dangerous fuel, special equipment and facilities must be used to store LPG, or to deliver LPG from place to place or to end-users.

SUMMARY OF THE INVENTION

It is one object of the present invention to provide a high efficient fuel gas, which can be quickly burned with a high temperature of flame for melting metal. It is another object of the present invention to provide a high combustion efficiency fuel gas, which is safe in use. It is still another object of the present invention to provide a high combustion efficiency fuel gas, which is inexpensive to obtain. According to the present invention, petroleum is drawn from a gas cylinder, and delivered to a light oil in an oil tank, so that a saturated inflammable gas is obtained from an outlet at the oil tank. The initial boiling point of the light oil is within 1°~110° C. The inflammable high combustion fuel gas thus obtained has the advantages of the conventional petroleum gas and acetylene.

DETAILED DESCRIPTION OF THE PREFERRED EMBODIMENT

Figure 1:
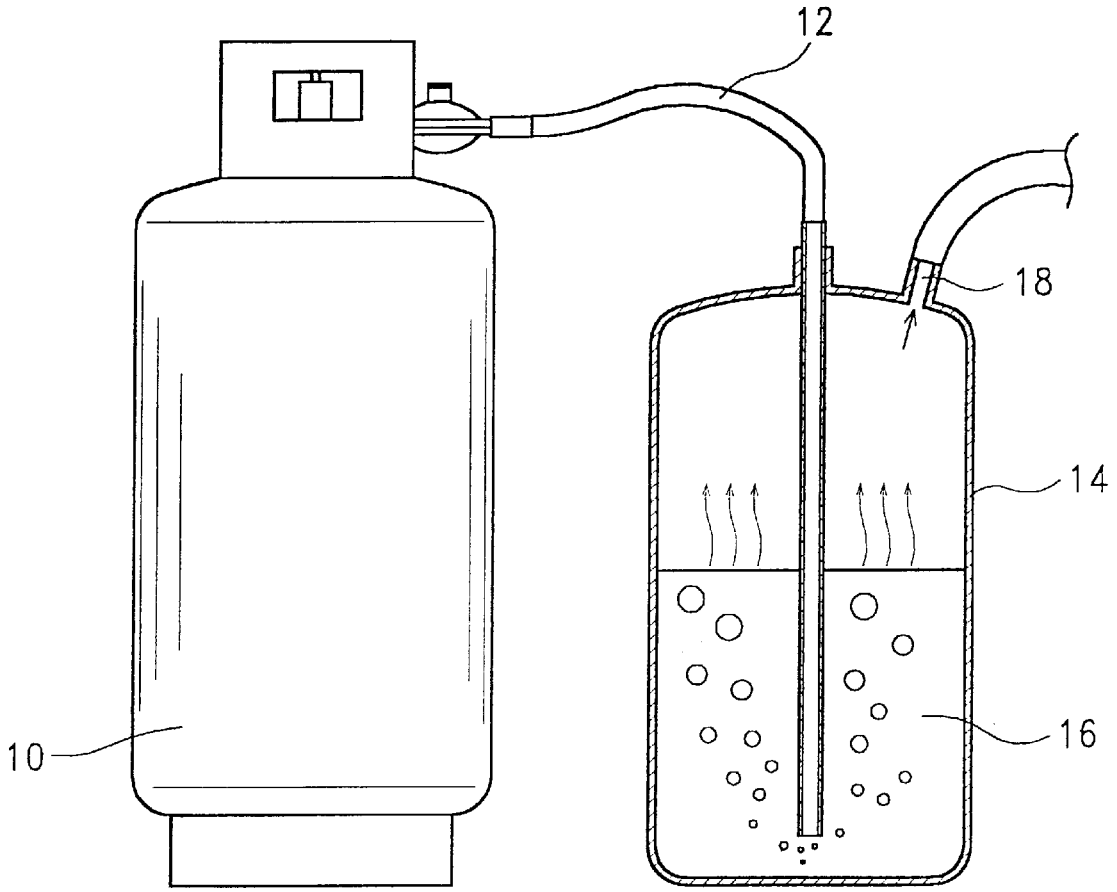
FIG. 1 illustrates an application example of the high combustion efficiency fuel gas according to the present invention.

Referring to FIG. 1, LPG (liquefied petroleum gas is drawn from a gas cylinder 10, and delivered through a gas tube 12 to a light oil 16 in an oil tank 14. When a certain amount of LPG is pumped into the light oil 16 in the oil tank 14, a saturated fuel gas of hydrocarbon compound is obtained from a gas outlet 18 at the oil tank 12. The light oil 16 preferably has an initial boiling point within 1° C.~110° C. The fuel gas thus obtained has the advantages of conventional LPG and acetylene.

The aforesaid LPG is a by-product obtained during cracking of petroleum, and comprised of propane, butane, propylene, butylenes, ethylene, and pentane. The fuel gas thus obtained in presented in the gaseous state under atmospheric pressure. However, it can be easily turned from the gaseous state into the liquid state simply by giving a pressure about 0.8~1.5 Mpa. When turned into the liquid state, it can be stored in a cylinder for delivery.

Because the aforesaid light oil is composed of butane, pentane, hexane, heptane, and octane. Butane and pentane are final waste material obtained from petroleum products. Reclaiming butane and pentane from waste petroleum products greatly reduces environmental pollution.

Because the fuel gas of the present invention is obtained from LPG and a light oil, its cost is low. Further, because the fuel gas can be turned from the gaseous state into the liquid state when a low pressure is added, it is safe in use. When burned, it produces a high temperature flame for melting metal. When used in welding, it achieves a smooth cutting surface on the workpiece, and oxidized iron chips can easily be removed from the workpiece.

As indicated above, the present invention provides a high combustion efficiency fuel gas, which achieves the advantages of acetylene and LPG, and can be quickly burned to provide a high temperature flame for melting metal when mixed with oxygen.

It is to be understood that the drawing is designed for purposes of illustration only, and is not intended for use as a definition of the limits and scope of the invention disclosed.

What the invention claimed is:

1. A high combustion efficiency fuel gas obtained from a saturated gas produced by pumping petroleum gas to a light oil composed of butane, pentane, hexane, heptane, and octane.

2. The high combustion efficiency fuel gas of claim 1 wherein the initial boiling point of said light oil is preferably within 1° C.~110° C.

3. The high combustion efficiency fuel gas of claim 1 wherein said petroleum gas is composed of propane, butane, propylene, butylenes, ethylene, and pentane.

* * * * *